US007453422B2

(12) United States Patent
Park

(10) Patent No.: US 7,453,422 B2
(45) Date of Patent: Nov. 18, 2008

(54) PLASMA DISPLAY PANEL HAVING AN APPARATUS AND METHOD FOR DISPLAYING PICTURES

(75) Inventor: Seung-Ho Park, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 785 days.

(21) Appl. No.: 10/983,110

(22) Filed: Nov. 5, 2004

(65) Prior Publication Data

US 2005/0116892 A1 Jun. 2, 2005

(30) Foreign Application Priority Data

Nov. 28, 2003 (KR) ..... 10-2003-0085504

(51) Int. Cl.
*G09G 3/10* (2006.01)
*G09G 3/28* (2006.01)
*G09G 5/10* (2006.01)

(52) U.S. Cl. ..... 345/60; 345/61; 345/690; 315/169.4

(58) Field of Classification Search ..... 345/60–84, 345/690; 315/169.4
See application file for complete search history.

(56) References Cited

U.S. PATENT DOCUMENTS

| | | | | |
|---|---|---|---|---|
| 6,310,588 | B1 | 10/2001 | Kawahara et al. | |
| 6,417,824 | B1 | 7/2002 | Tokunaga et al. | |
| 6,965,358 | B1 * | 11/2005 | Kasahara et al. | 345/63 |
| 7,236,147 | B2 * | 6/2007 | Morita et al. | 345/63 |
| 7,339,632 | B2 * | 3/2008 | Weitbruch et al. | 348/797 |
| 2006/0145952 | A1 * | 7/2006 | Takahashi | 345/60 |

FOREIGN PATENT DOCUMENTS

| | | | |
|---|---|---|---|
| CN | 1288221 | A | 3/2001 |
| EP | 1 071 069 | A2 | 1/2001 |
| JP | 11-231827 | A | 8/1999 |
| JP | 2000-188702 | A | 7/2000 |
| JP | 2000-276100 | A | 10/2000 |

(Continued)

OTHER PUBLICATIONS

Korean Patent Abstracts for Publication No. 1020020024669; Date of publication of application Apr. 1, 2002, in the name of Choon Woo Kim et al.

(Continued)

*Primary Examiner*—David L Lewis
(74) *Attorney, Agent, or Firm*—Christie, Parker & Hale, LLP

(57) ABSTRACT

A PDP image processing method for dividing an image of a field displayed on the PDP into subfields in correspondence to an input image signal, representing gray scales according to combinations of the subfields, and displaying an image corresponding to the image signal. Image signals of a current input frame and a previous input frame are used. A contour noise stage is determined through calculating coding errors and mean gray scale differences. The applicability of the current input image signal to the contour noise stage is determined. Whether to apply dithering is determined. The gray scale of the current input image signal is converted into a gray scale for reducing the contour noise by using dithering, when it is determined to apply dithering.

13 Claims, 10 Drawing Sheets

FOREIGN PATENT DOCUMENTS

| | | | |
|---|---|---|---|
| JP | 2001-337648 | A | 12/2001 |
| JP | 2002-82649 | A | 3/2002 |
| JP | 2002-229510 | A | 1/2003 |
| JP | 2003-15589 | A | 1/2003 |
| JP | 2003-66896 | A | 3/2003 |
| JP | 2003-177696 | A | 6/2003 |
| KR | 1999-014172 | | 2/1999 |
| KR | 2002-0024669 | | 4/2002 |
| KR | 2003-0006074 | | 1/2003 |

OTHER PUBLICATIONS

Korean Patent Abstracts for Publication No. 1020030006074; Date of publication of application Jan. 23, 2003, in the name of Choon Woo Kim et al.

* cited by examiner

FIG.8a

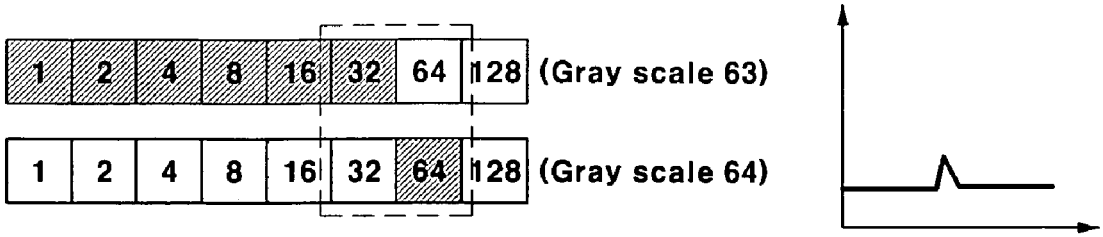

Different light emitted patterns with weight of 64

FIG.8b

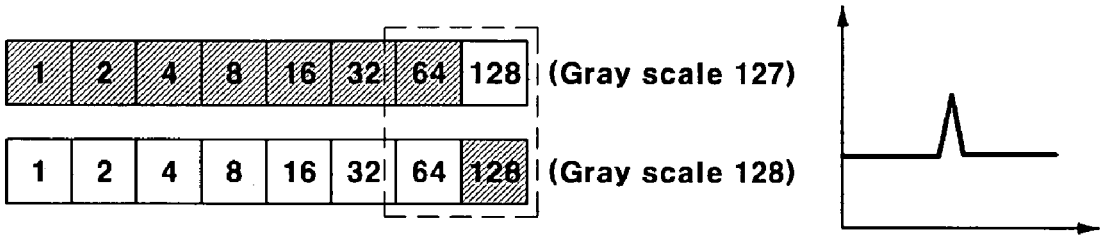

Different light emitted patterns with weight of 128

FIG.9

| Coding error stages | Coding error ranges |
|---|---|
| 0 | 0<coding_criterion(block)<1 |
| 1 | 1<coding_criterion(block)<3 |
| 2 | 3<coding_criterion(block)<5 |
| 3 | 5<coding_criterion(block)<7 |
| 4 | 7<coding_criterion(block)<9 |
| 5 | 9<coding_criterion(block)<11 |
| 6 | 11<coding_criterion(block)<15 |
| 7 | 15<coding_criterion(block)<20 |
| 8 | 20<coding_criterion(block)<30 |
| 9 | 30<coding_criterion(block)<40 |
| 10 | 40<coding_criterion(block) |

FIG.10

| Gray scale difference stages | Gray scale difference ranges |
|---|---|
| 0 | 0<diff_criterion(block)<1 or 80<diff_criterion(block) |
| 1 | 1<diff_criterion(block)<5 |
| 2 | 5<diff_criterion(block)<10 |
| 3 | 10<diff_criterion(block)<15 |
| 4 | 15<diff_criterion(block)<20 |
| 5 | 20<diff_criterion(block)<30 |
| 6 | 30<diff_criterion(block)<40 |
| 7 | 40<diff_criterion(block)<50 |
| 8 | 50<diff_criterion(block)<60 |
| 9 | 60<diff_criterion(block)<70 |
| 10 | 70<diff_criterion(block)<80 |

FIG.11

| Coding error stages | Gray scale difference stages | Determination of contour noise stage |
|---|---|---|
| 0~10 | 0 | 0 |
| 0 | 0~10 | 0 |
| 1 | 0~5 | 0 |
| | 6~10 | 1 |
| 2 | 1~3 | 1 |
| | 4~6 | 2 |
| | 7~10 | 3 |
| 3 | 1~3 | 2 |
| | 4~6 | 3 |
| | 7~10 | 4 |
| 4 | ··· | 3~5 |
| 5 | ··· | 4~6 |
| 6 | ··· | 5~7 |
| 7 | ··· | 6~8 |
| 8 | ··· | 7~9 |
| 9 | ··· | 8~10 |
| 10 | 1~5 | 9 |
| | 6~10 | 10 |

FIG.13

| Gray scales | Subfield arrangements | | | | | | | | | |
|---|---|---|---|---|---|---|---|---|---|---|
| | 1 | 2 | 4 | 8 | 16 | 32 | 42 | 44 | 52 | 54 |
| 0 | 0 | 0 | 0 | 0 | 0 | 0 | 0 | 0 | 0 | 0 |
| 1 | 1 | 0 | 0 | 0 | 0 | 0 | 0 | 0 | 0 | 0 |
| 2 | 0 | 1 | | | | | | | | |
| 3 | 1 | 1 | 0 | 0 | 0 | 0 | 0 | 0 | 0 | 0 |
| 4 | 0 | 0 | 1 | | | | | | | |
| 5 | 1 | 0 | 1 | | | | | | | |
| 6 | 0 | 1 | 1 | | | | | | | |
| 7 | 1 | 1 | 1 | 0 | 0 | 0 | 0 | 0 | 0 | 0 |
| ... | ... | | | | | | | | | |
| 15 | 1 | 1 | 1 | 1 | 0 | 0 | 0 | 0 | 0 | 0 |
| ... | ... | | | | | | | | | |
| 31 | 1 | 1 | 1 | 1 | 1 | 0 | 0 | 0 | 0 | 0 |
| ... | ... | | | | | | | | | |
| 63 | 1 | 1 | 1 | 1 | 1 | 1 | 0 | 0 | 0 | 0 |
| ... | ... | | | | | | | | | |
| 105 | 1 | 1 | 1 | 1 | 1 | 1 | 1 | 0 | 0 | 0 |
| ... | ... | | | | | | | | | |
| 149 | 1 | 1 | 1 | 1 | 1 | 1 | 1 | 1 | 0 | 0 |
| ... | ... | | | | | | | | | |
| 201 | 1 | 1 | 1 | 1 | 1 | 1 | 1 | 1 | 1 | 0 |
| ... | ... | | | | | | | | | |
| 255 | 1 | 1 | 1 | 1 | 1 | 1 | 1 | 1 | 1 | 1 |

| | | | | | | | |
|---|---|---|---|---|---|---|---|
| 11 | 43 | 16 | 48 | 3 | 35 | 7 | 39 |
| 59 | 27 | 64 | 32 | 51 | 19 | 55 | 23 |
| 5 | 37 | 6 | 38 | 10 | 42 | 12 | 44 |
| 53 | 21 | 54 | 22 | 58 | 26 | 60 | 28 |
| 15 | 47 | 2 | 34 | 14 | 46 | 4 | 36 |
| 63 | 31 | 50 | 18 | 62 | 30 | 52 | 20 |
| 1 | 33 | 9 | 41 | 8 | 40 | 13 | 45 |
| 49 | 17 | 57 | 25 | 56 | 24 | 61 | 29 |

PLASMA DISPLAY PANEL HAVING AN APPARATUS AND METHOD FOR DISPLAYING PICTURES

CROSS REFERENCE TO RELATED APPLICATION

This application claims priority to and the benefit of Korean Patent Application No. 10-2003-0085504 filed on Nov. 28, 2003 in the Korean Intellectual Property Office, the contents of which are incorporated herein by reference.

BACKGROUND OF THE INVENTION (a) Field of the Invention

The present invention relates to a driving apparatus of a plasma display panel (PDP) and a method for displaying pictures on the plasma display panel, and more particularly, to a driving apparatus of a plasma display panel (PDP) and a method for displaying pictures on the plasma display panel which are capable of reducing contour noise.

(b) Description of the Related Art

Recently, flat panel displays, such as liquid crystal displays (LCDs), field emission displays (FEDs), and PDPs have been actively developed. The PDPs are becoming preferred over the other flat panel displays with regard to their high luminance, high luminous efficiency, and wide viewing angle. Accordingly, the PDPs are being highlighted as a substitute for conventional cathode ray tubes (CRTs) for large-screen displays of more than 40 inches.

The PDPs are flat panel displays that use plasma generated by gas discharge to display characters or images. The PDPs include, according to their size, more than several tens to millions of pixels arranged in the form of a matrix. These PDPs are classified into a direct current (DC) type and an alternating current (AC) type according to patterns of waveforms of driving voltages applied thereto and discharge cell structures thereof.

The DC PDP has electrodes exposed to a discharge space, thereby causing current to directly flow through the discharge space during application of a voltage to the DC PDP. In this connection, the DC PDP has a disadvantage in that it requires a resistor for limiting the current. On the other hand, the AC PDP has electrodes covered with a dielectric layer that naturally forms a capacitance component to limit the current and protects the electrodes from the impact of ions during discharge. As a result, the AC PDP is considered superior to the DC PDP with regard to a long lifetime.

FIG. 1 is a perspective view illustrating a part of an AC PDP. Scan electrodes 4 and sustain electrodes 5 covered with dielectric layer 2 and protective layer 3 are arranged in pairs in parallel on first glass substrate 1. A plurality of address electrodes 8 covered with insulation layer 7 are arranged on second glass substrate 6. Barrier ribs 9 are formed in parallel with address electrodes 8 on insulation layer 7 such that each barrier rib 9 is interposed between adjacent address electrodes 8. Phosphor 10 is coated on the surface of insulation layer 7 and on both sides of each partition wall 9. First and second glass substrates 1, 6 are arranged to face each other while defining discharge space 11 therebetween so that address electrodes 8 are orthogonal to scan electrodes 4 and sustain electrodes 5. In the discharge space, discharge cell 12 is formed at an intersection between each address electrode 8 and each pair of the scan electrodes 4 and sustain electrodes 5.

FIG. 2 shows an arrangement of the electrodes in the PDP of FIG. 1. The electrodes of the PDP are arranged in the form of an m×n matrix. m address electrodes A1 to Am are arranged in a column direction. n scan electrodes Y1 to Yn and n sustain electrodes X1 to Xn are alternately arranged in a row direction. Discharge cell 12 shown in FIG. 2 corresponds to discharge cell 12 shown in FIG. 1.

In general, a process for driving the AC PDP can be expressed by temporal operation periods, i.e., a reset period, an address period, and a sustain period. The reset period is a period wherein the state of each cell is initialized such that an addressing operation of each cell is smoothly performed. The address period is a period wherein an address voltage is applied to an (addressed) cell to accumulate wall charges on the addressed cell to in order to select a cell to be turned on and a cell not to be turned on in the PDP. The sustain period is a period wherein sustain pulses are applied to the addressed cell, thereby performing a discharge according to which a picture is actually displayed.

As shown in FIG. 3, in the PDP, a gray scale is expressed by dividing one frame (1 TV frame) into a plurality of sub-fields and performing a time-division operation for the plurality of sub-fields. Each sub-field includes the reset period, the address period, and the sustain period. FIG. 3 illustrates one frame divided into 8 sub-fields in order to express 256 levels of gray scale. As shown in the figure, each sub-field SF1-SF8 includes reset periods (not shown), address periods Ad1-Ad8, and sustain periods S1-S8. Sustain periods S1-S8 have emission periods 1T, 2T, 4T, . . . , 128T of the ratio of 1:2:4:8:16:32:64:128.

For example, a level 3 of gray scale is expressed by discharging a discharge cell in a sub-field having an emission period of 1T and a sub-field having an emission period of 3T so as to have a total emission period of 3T. In this way, a combination of different sub-fields having different emission periods produces pictures of 256 levels of gray scale.

When a moving picture is displayed according to the sub-field arrangement, contour noise is generated due to human visual properties. FIG. 4 is a diagram illustrating one example of the generation of the contour noise. If the moving picture having a level 127 of gray scale and a level 128 of gray scale in parallel moves to the right at a fixed speed, the contour noise may be exhibited as shown in FIG. 4 according to the sub-field arrangement shown in FIG. 3. According to a property that human vision catches up with the movement of the picture, the gray scale is perceived in an arrow direction as shown in FIG. 4. Accordingly, contour noise, such as a level 255 of gray scale, is generated between the level 127 of gray scale and the level 128 of gray scale.

SUMMARY OF THE INVENTION

In accordance with the present invention a plasma display panel driver for reducing contour noise, and a plasma display panel image processing method is provided.

In one aspect of the present invention, a plasma display panel driver includes: a contour noise estimator for using an image signal of a current input frame and an image signal of a previous input frame, calculating a coding error and a mean gray scale difference, and determining a contour noise stage of the image signal of the current input frame for each block; a gray scale converter for determining whether the image signal of the current input frame is applicable to the contour noise stage determined by the contour noise estimator, determining whether to apply dithering, and using the dithering to convert an input gray scale into a gray scale for reducing the contour noise when applying the dithering; and a subfield converter for generating subfield data corresponding to the gray scale converted by the gray scale converter.

In another aspect of the present invention, an image processing method for a plasma display panel for dividing an image of a field displayed on the plasma display panel into a plurality of subfields in correspondence to an input image signal, representing gray scales according to combinations of the subfields, and displaying an image corresponding to the image signal, includes: (a) using an image signal of a current input frame and an image signal of a previous input frame, and determining a contour noise stage through calculating coding errors and mean gray scale differences; (b) determining whether the current input image signal is applicable to the contour noise stage determined in (a), and determining whether to apply dithering; and (c) converting the gray scale of the current input image signal into a gray scale for reducing the contour noise by using dithering, when it is determined to apply dithering in (b).

In still another aspect of the present invention, a plasma display panel includes a plasma panel including first and second electrodes arranged in parallel on a first substrate and third electrodes formed to cross the first and second electrodes on a second substrate, a driver for applying sustain pulses for driving the first and second electrodes, and a controller for dividing a frame into a plurality of subfields and applying a control signal to the driver, the control signal controlling the number of the subfields which form the frame and the number of sustain pulses assigned to each subfield, wherein the controller includes: a contour noise estimator for using an image signal of a current input frame and an image signal of a previous input frame, calculating a coding error and a mean gray scale difference, and determining a contour noise stage of the image signal of the current input frame for each block; a gray scale converter for determining whether the image signal of the current input frame is applicable to the contour noise stage determined by the contour noise estimator, determining whether to apply dithering, and using the dithering to convert an input gray scale into a gray scale for reducing the contour noise when applying the dithering; and a subfield converter for generating subfield data corresponding to the gray scale converted by the gray scale converter.

In yet another aspect of the present invention, an image processing method for a plasma display panel for dividing an image of a field displayed on the plasma display panel into a plurality of subfields in correspondence to an input image signal, representing gray scales according to combinations of the subfields, and displaying an image corresponding to the image signal, includes: (a) using a first image signal of a current input frame and a second image signal of a previous input frame, and determining a contour noise stage; (b) determining whether first image signal is applicable to the contour noise stage determined in (a); (c) selecting a first gray scale and a second gray scale as output candidates from among gray scales available in the contour noise stage corresponding to the first image signal when the first image signal is determined not to be an applicable gray scale in (b); and (d) using the first and second gray scales selected in (a), applying dithering, and representing the first image signal.

BRIEF DESCRIPTION OF THE DRAWINGS

FIG. 8*a* shows an amount of contour noise in the case of different light emission patterns with the weight of 64.

FIG. 8*b* shows an amount of contour noise in the case of different light emission patterns with the weight of 128.

FIG. 9 shows a table for classified coding error stages according to coding error sizes.

FIG. 10 shows a table for classified gray scale difference stages according to gray scale difference ranges.

FIG. 11 shows a table for contour noise stages predetermined by the classified coding error stages and gray scale difference stages in FIGS. 9 and 10.

FIG. 13 shows a table for coding part of gray scales when a subfield arrangement is given as {1 2 4 8 16 32 42 44 52 54}.

DETAILED DESCRIPTION

Figure 1:
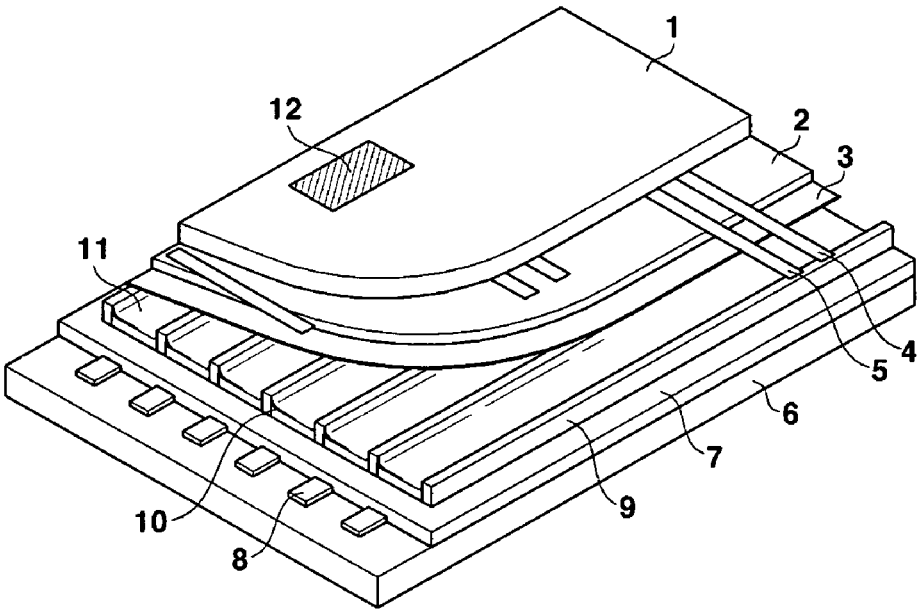
FIG.1 (Prior Art)
FIG. 1 shows a perspective view illustrating part of an AC PDP.
Figure 2:
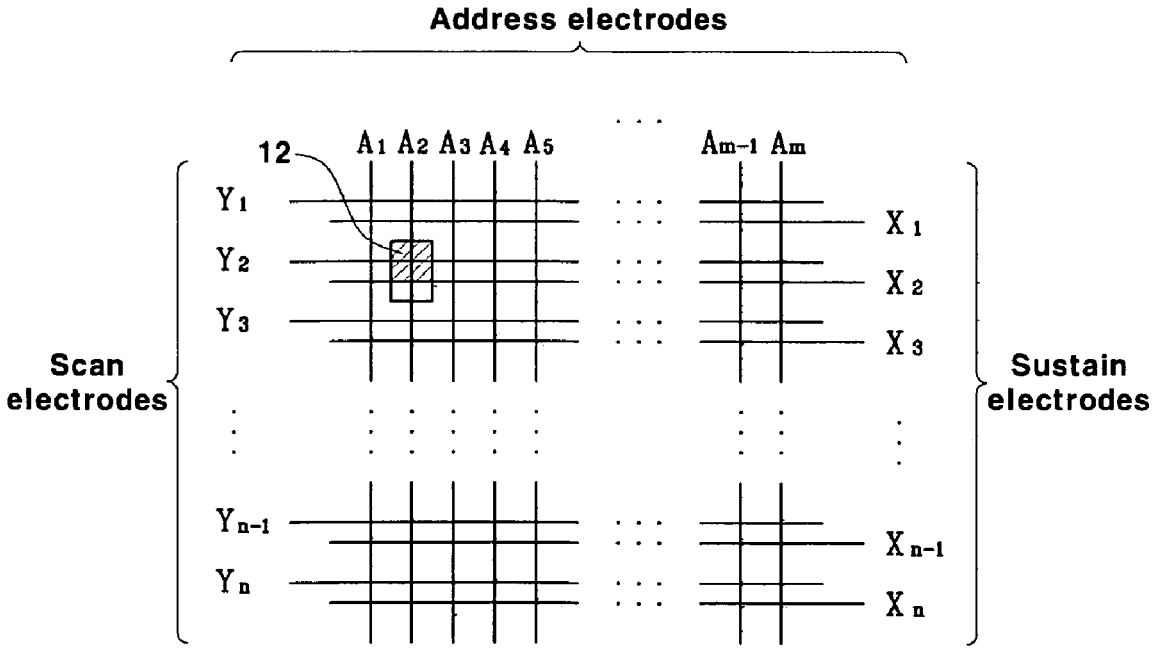
FIG.2 (Prior Art)
FIG. 2 shows a schematic view illustrating an arrangement of electrodes in the PDP of FIG. 1.
Figure 3:
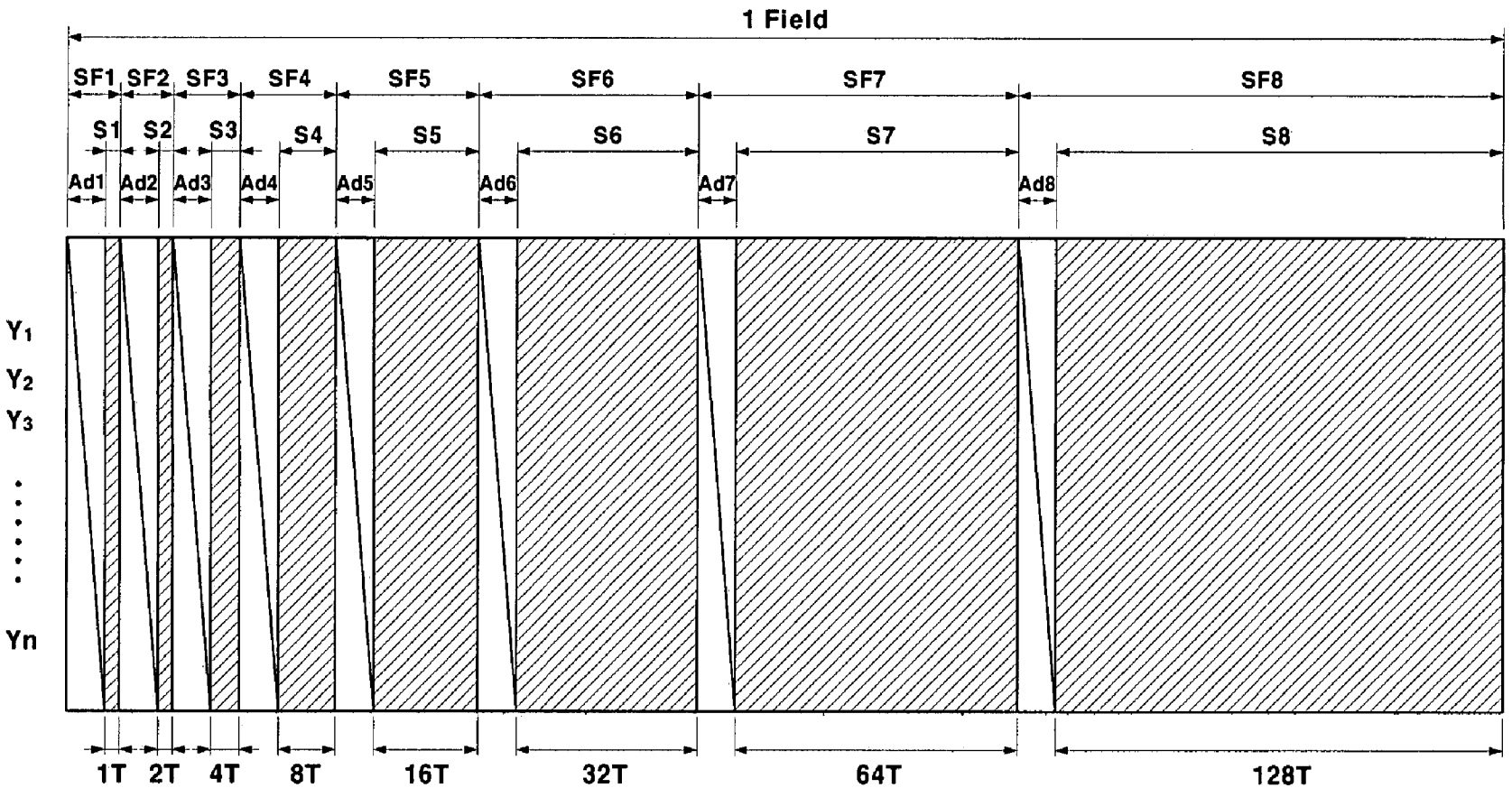
FIG.3 (Prior Art)
FIG. 3 shows a diagram illustrating a method for expressing a gray scale in the PDP.
Figure 4:
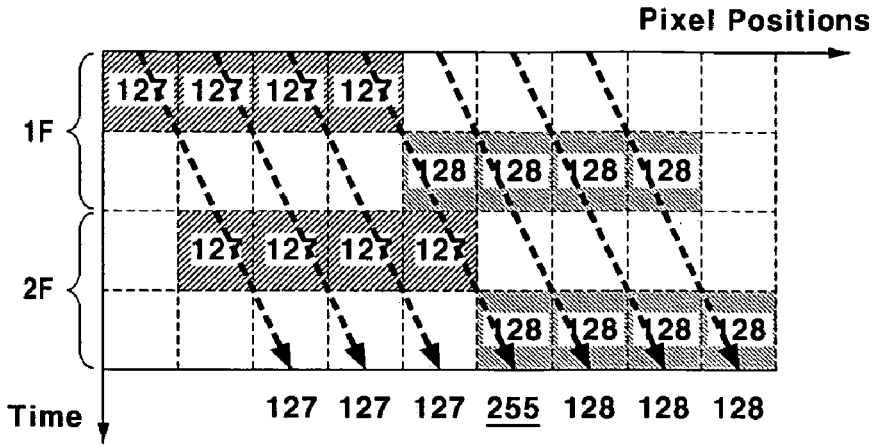
FIG.4 (Prior Art)
FIG. 4 shows a diagram illustrating one example of generation of contour noise.
Figure 5:
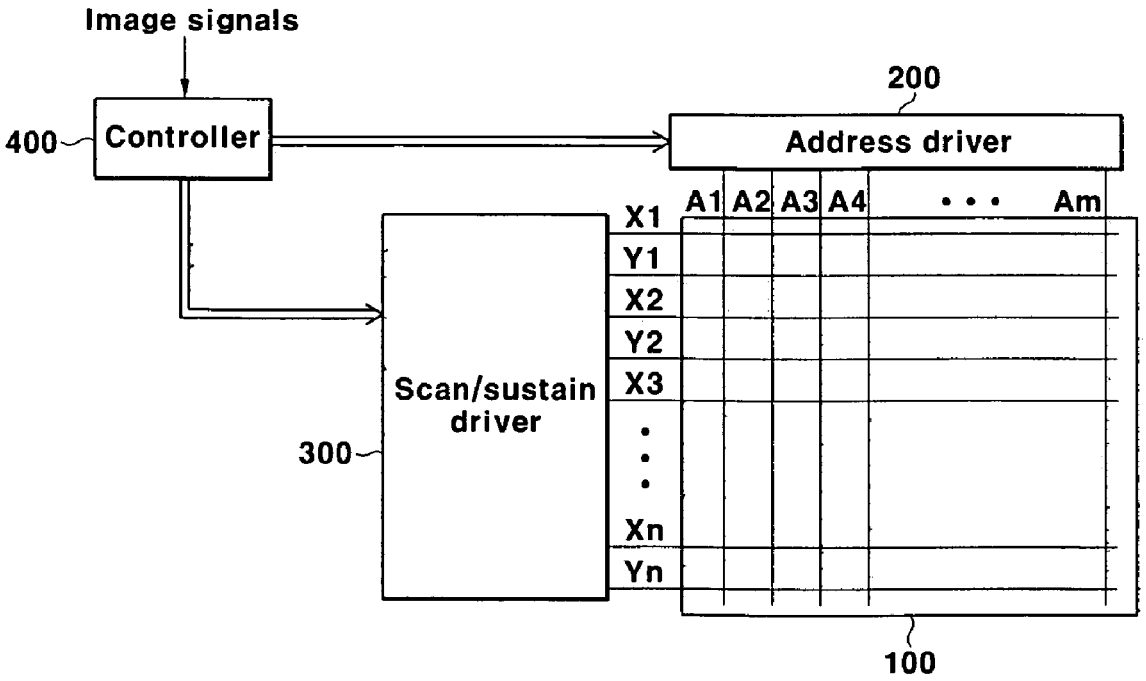
FIG. 5 shows a block diagram of a PDP according to an exemplary embodiment of the present invention.

Referring now to FIG. 5, a PDP according to an exemplary embodiment of the present invention includes plasma panel 100, address driver 200, scan and sustain driver 300, and controller 400.

Plasma panel 100 includes a plurality of address electrodes A1 to Am arranged in a column direction, and a plurality of scan electrodes Y1 to Yn and a plurality of sustain electrodes X1 to Xn alternately arranged in a row direction. Address driver 200 receives an address driving control signal from controller 400, and applies display data signals to respective address electrodes A1 to Am for selecting desired discharge cells. Scan and sustain driver 300 receives a control signal from controller 400, and alternately applies sustain pulse voltages to scan electrodes Y1 to Yn and sustain electrodes X1 to Xn, respectively, thereby causing selected discharge cells to perform a sustain discharge.

Controller 400 externally receives image (video) signals, such as a red, green, blue (RGB) image signal and a synchronization signal, divides one frame of the RGB image signal into a plurality of sub-fields, and divides each sub-field into a reset period, an address period, and a sustain period for driving the PDP. Controller 400 then supplies address driver 200 and scan and sustain driver 300 with a required control signal by adjusting the number of sustain pulses to be applied during each sustain period of each sub-field within one frame.

Figure 6:
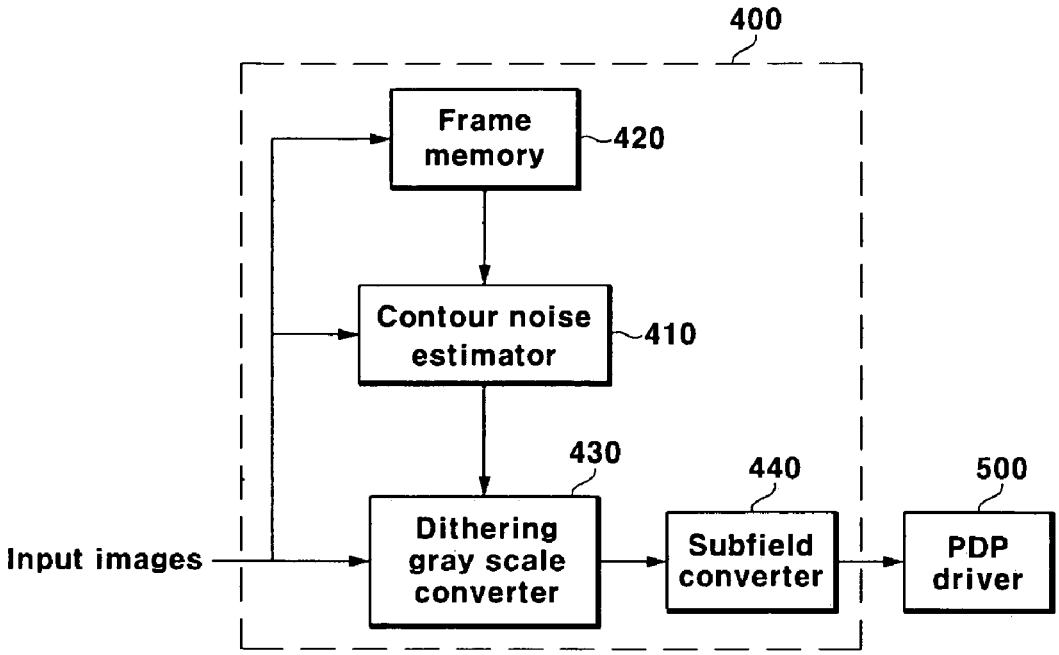
FIG. 6 shows a block diagram of a controller of the PDP according to an exemplary embodiment of the present invention.

Controller 400 according to the embodiment of the present invention will be described in more detail with reference to FIGS. 6 to 15. As shown in FIG. 6, controller 400 of the plasma display panel includes contour noise estimator 410, frame memory 420, dithering gray scale converter 430, and subfield converter 440.

Contour noise estimator 410 uses an image signal of a current input frame and an image signal of a previous frame previously stored in frame memory 420, calculates a coding error on the image signal of the current input frame, and calculates a mean gray scale difference to determine contour noise of the input image signal, by dividing the frame into predetermined sizes of blocks for image quality improvements of the total frame. A detailed method for contour noise estimator 410 to estimate contour noise will now be described.

Figure 7:
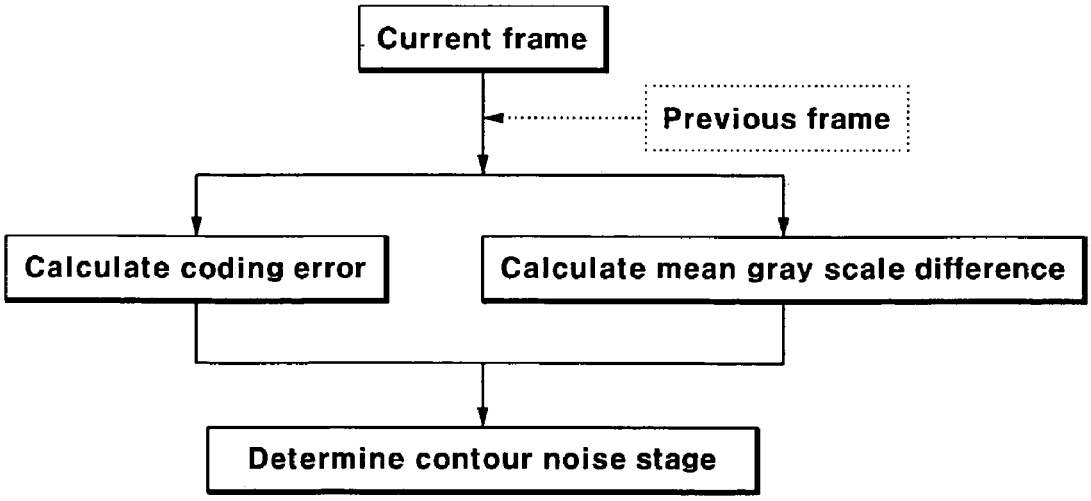
FIG. 7 shows a flowchart for a contour noise estimator according to an exemplary embodiment of the present invention.

FIG. 7 shows a flowchart for a contour noise estimator to estimate contour noise according to an exemplary embodiment of the present invention. The current frame and the previous frame in FIG. 7 are provided since data of the current frame and the previous frame are required for estimation of contour noise. Contour noise estimator 410 initially calculates coding errors as a calculation process.

The probability of the generation of contour noise increases when the light emitted patterns of subfields, i.e. distribution patterns of coding, are different while the gray scales of two successive frames are similar. Also, the probability of the generation of moving picture contour noise increases when the weights of the subfields with different light-emitted states are greater. FIGS. 8*a* and 8*b* show examples of a pattern that may generate contour noise. FIG. 8*a* shows the quantity of contour noise when the light emitted patterns with the weight of 64 are different. FIG. 8*b* shows the quantity of contour noise when the light emitted patterns with the weight of 128 are different. That is, FIG. 8*a* shows the quantity of contour noise when the gray scale of the previous frame is 63 and the gray scale of the present frame is 64, and FIG. 8*b* shows the quantity of contour noise when the gray scale of the previous frame is 127 and the gray scale of the present frame is 128. The peak values in the graphs of FIGS. 8*a* and 8*b* show the quantity of contour noise, in which much contour noise is generated when the light-emitted patterns with the weight of 128 are different as shown in FIG. 8*b*.

Contour noise estimator 410 estimates degrees of moving picture contour noise according to the above-noted principle. That is, contour noise estimator 410 compares the light emitted patterns of the gray scale of the pixels of the present frame provided at the same position as those of the pixels of the previous frame, and estimates that much contour noise has been generated when the light emitted patterns with greater weights are different.

A detailed method in which contour noise estimator 410 estimates the contour nose will now be described. Equation 1 shows a method for calculating the degree of contour noise at random pixels.

$$\text{coding_criterion}(x, y) = \left(\sum_{p=1}^{m} |B_{i_n}(p) - B_{i_{n-1}}(p)| \times SP(p) - |i_n(x, y) - i_{n-1}(x, y)|\right) \times \text{weight}[i_n(x, y)] \quad \text{Equation 1}$$

In Equation 1, $i_n(x,y)$ designates a gray scale at the (x,y) position of the present frame image data, and $i_{n-1}(x,y)$ designates a gray scale at the (x,y) position of the previous frame. $B_{in}(p)$ and $B_{in-1}(p)$ are light-emitted pattern information given as 0 and 1 for the p-th subfield with respect to the $i_n(x,y)$ and $i_{n-1}(x,y)$. SP(p) designates a weight of the p-th subfield, and m designates a number of subfields. In this case, the difference of gray scales of the previous frame and the present frame (which corresponds to an absolute value of $i_n(x,y)-i_{n-1}(x,y)$) is subtracted as given in Equation 1, because the smaller the gray scale difference between the previous frame and the present frame becomes, the greater the quantity of contour noise becomes.

In addition, the weight $[i_n(x,y)]$ designates weights at the respective gray scales determined according to the current gray scales. Generally, the visual sense of a person is more sensitive to a brightness difference in a dark area. That is, even at the same quantity of contour noise, the contour noise in a dark area is more disagreeable than that in a bright area. Accordingly, predetermined weights weight $[i_n(x,y)]$ for respective gray scales are multiplied as given in Equation 1 in order to consider such a phenomenon. In this instance, the weights for respective gray scales are predetermined to be greater for the darker gray scales.

Equation 1 shows degrees of the contour noise for respective pixels, and the final degree of the contour noise is given in Equation 2.

$$\text{coding_criterion(block)} = \frac{1}{n^2}\sum_{x=0}^{n}\sum_{y=0}^{n} \text{coding_criterion}(x, y) \quad \text{Equation 2}$$

where n indicates a size of a block. Therefore, the degrees of contour noise are calculated by calculating the coding errors for the respective blocks of the plasma display panel according to Equation 2.

The second stage for estimating contour noise is to calculate the mean gray scale difference as shown in FIG. 7. Since contour noise is more probable to be generated when a motion in the image is greater, mean gray scale differences for respective blocks are calculated in order to use motion amount information. Since the gray scale difference becomes greater as the motion becomes greater in general, motion stages are calculated according to the per-block mean gray scale differences, and the calculated motion stages are used for contour noise estimator 410 to estimate contour noise. The mean gray scale differences are calculated as given in Equation 3.

$$\text{diff_criterion}(x,y) = |i_n(x,y) - i_{n-1}(x,y)| \quad \text{Equation 3}$$

In this instance, since Equation 3 represents pixel-based calculation, the per-block mean gray scale difference is calculated as given in Equation 2.

Contour noise estimator 410 determines contour noise by using the coding error stage determined according to the calculated coding error value and the gray scale difference stage determined by the mean gray scale difference calculation, after calculating the coding error and the mean gray scale difference. That is, the contour noise stage is finally determined according to the values of the coding error stage and gray scale difference stage.

In this instance, the coding error stage is classified as several stages according to the coding error size calculated by Equation 2, and is predefined. FIG. 9 shows a classified coding error stage according to the coding error size. As shown, the cases with less coding errors are further classified since visually sensible contour noise is more sensitive in the case of less coding errors on the plasma display panel, and it is very difficult to distinguish them when the coding errors are somewhat large. The coding error stage shown in FIG. 9 is one example, and it is understood by a person skilled in the art that the stages and ranges of coding errors can be varied.

The gray scale difference stage is classified as several stages according to the gray scale differences calculated by Equation 3, and is predefined. FIG. 10 shows a classified gray scale difference stage according to a gray scale difference range. When the gray scale difference is less than 1, the gray scale difference stage is defined to be 0 since the images have very few changes between frames and no contour noise is likely to be generated. When the gray scale difference is very large, the gray scale difference stage is defined to be 0 since the images are not consecutive but they are very likely to be changed scenes and very much less contour noise is likely to be generated. The gray scale difference stage shown in FIG. 10 is one example, and it is understood by a person skilled in the art that the stages and ranges of gray scale differences can be varied.

When finally determining the coding error stage and the gray scale difference stage, contour noise estimator 410 determines the contour noise stage which has been determined by using the coding error stage and the gray scale difference stage found in FIGS. 9 and 10. FIG. 11 shows the determined contour noise stage.

The determined contour noise stage includes eleven stages from 0 to 10, as shown in FIG. 11. In this instance, the contour noise stage of 0 represents a state with the lowest probability of generating the contour noise, and the contour noise stage of 10 represents a state with the highest probability of generating the contour noise. Since the coding error stage and the gray scale difference stage represent a high contour noise generation probability as they become greater, the contour noise stage is established to have a high value when they are high, and the contour noise stage is established to have a low value when they are low. Also, the contour noise stage is established to be zero when at least one of them is zero.

In addition, as shown in FIG. 11, the range of stages which can be determined according to the coding error stage is restricted in the contour noise stage determination result, and the contour noise stage is determined according to the range of the gray scale difference stage in the same coding error stage. For example, the contour noise stages to be determined becomes 0 and 1 when the coding error stage is given 1, the final contour noise stage becomes 0 when the coding error stages are given as 0 to 5, and the contour noise stage becomes 1 when the coding error stages are given as 6 to 10. When establishing three contour noise stages to each coding error stage, the gray scale difference stage is divided into three ranges to determine the final contour noise stage. That is, when the coding error stage is 2, the contour noise stage is defined to be 1 when the gray scale difference stages are given as 1 to 3, the contour noise stage is defined to be 2 when the gray scale difference stages are given as 4 to 6, and the contour noise stage is defined to be 3 when the gray scale difference stages are given as 7 to 10. The final contour noise stages for the coding error stages of from 4 to 9 are determined by dividing the gray scale difference stages in a like manner of the above-described method. The final contour noise stage has been determined with reference to the coding error stage as shown in FIG. 11 because the coding error directly reflects degrees of contour noise. The contour noise stage shown in FIG. 11 is an example, and it can be varied by a person skilled in the art through the coding error stage and the gray scale difference stage.

According to the above-noted method, contour noise estimator 410 uses the current input frame's image signal and the previous input frame's image signal, uses the coding error stage determined through the coding error calculation (refer to Equation 2) and the gray scale difference stage determined through the mean gray scale difference calculation (refer to Equation 3), and thus determines the contour noise stage. In this instance, the coding error stage (shown in FIG. 9), the gray scale difference stage (shown in FIG. 10), and the contour noise stage (shown in FIG. 11) are stored in a table format in contour noise estimator 410, and contour noise estimator 410 uses such tables, determines respective stages of the input image signals through coding error calculation and mean gray scale difference calculation, and determines the final contour noise stage.

Referring again to FIG. 6, dithering gray scale converter 430 uses a current input gray scale value and the contour noise stage estimated by contour noise estimator 410 to determine whether to apply dithering, and uses dithering and converts the input gray scale into a gray scale which reduces contour noise when applying the dithering. A method for dithering gray scale converter 430 to determine whether to apply dithering and convert gray scales by using dithering will now be described in detail. The contour noise stage determination by contour noise estimator 410 has been performed not by pixels but by blocks, and a subsequent dithering applying determination process and a dithering applying process performed by dithering gray scale converter 430 are performed for each pixel which configures a corresponding block.

Figure 12:
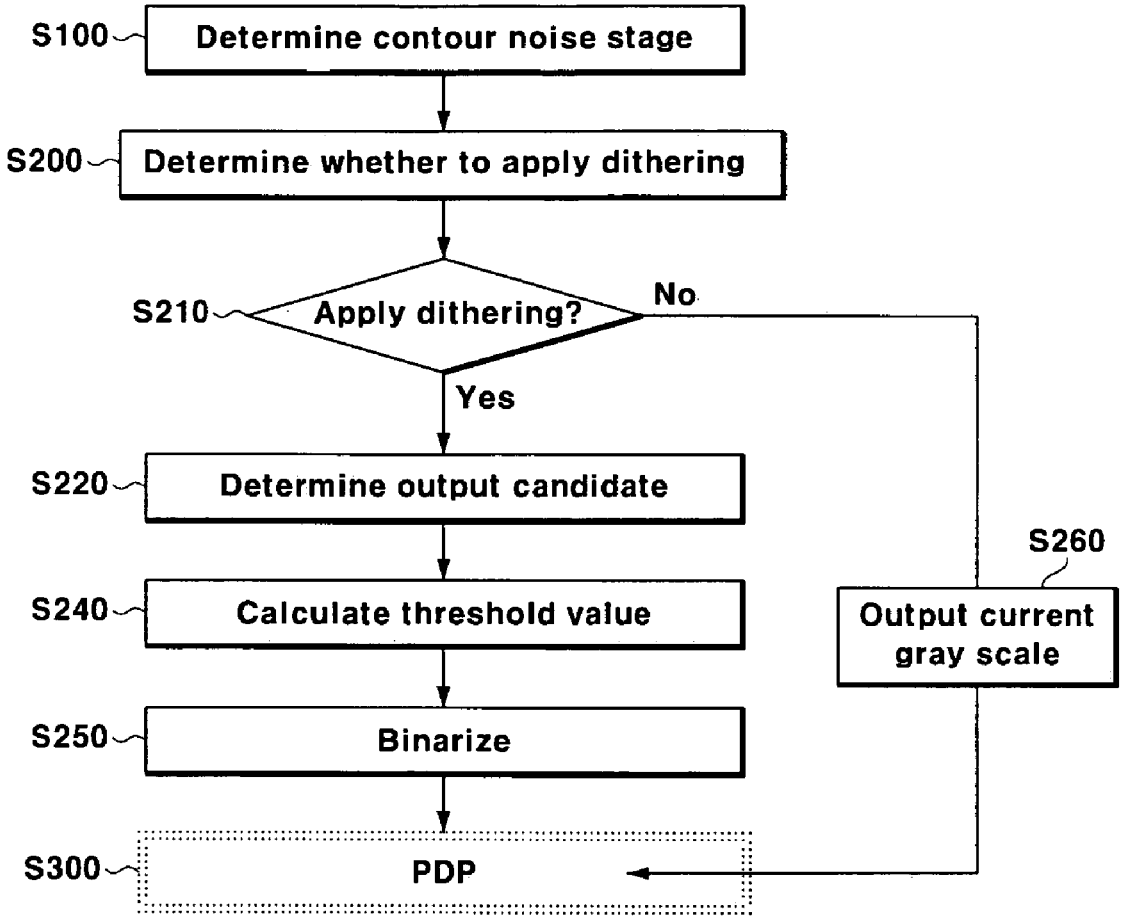
FIG. 12 shows a flowchart for processes performed in detail by a gray scale converter using dithering.

FIG. 12 shows a flowchart for the processes executed by dithering gray scale converter 430. Dithering gray scale converter 430 uses contour noise stage S100 estimated by contour noise estimator 410 and the current input gray scale and determines whether to convert the input gray scale by using dithering, that is, whether to apply dithering in steps S200 and S210 according to usable gray scales defined by the contour noise stages. Dithering gray scale converter 430 predefines contour noise stages allowable for respective gray scales, and uses the current gray scale and the contour noise stage calculated by contour noise estimator 410 to determine whether to apply dithering. Dithering gray scale converter 430 outputs a current gray scale in steps S210 and S260 when not applying dithering.

The gray scales available for the respective contour noise stages are determined by coding which indicates light emitted states of per-gray-scale subfields as disclosed in Korean Published Application No. 1999-014172. When the gray scales are coded, a contour noise stage allowable for each gray scale is determined according to uniformity degrees in the time domain. FIG. 13 shows a table for part of coded gray scales when a subfield arrangement is given {1 2 4 8 16 32 42 44 52 54}. When contour noise estimator 410 determines that a corresponding block is the stage of 10 which is the greatest contour noise stage in the above-noted coded gray scales, eleven gray scales of 0, 1, 3, 7, 15, 31, 63, 105, 149, 201, and 255 which represent completely uniform gray scales in the temporal manner are allowed by the coding. As the contour noise stage becomes lower, gray scales which reduce some temporal uniformity of coding are allowed and allowable used gray scales are accordingly increased, and 256 gray scales are available when the contour noise stage is the lowest. For example, when the contour noise stage is the ninth stage which is one stage below the top stage, gray scales with non-uniform coding and with the minimum subfield weight of '1' are available in addition to the eleven gray scales used for the above-described 10 stages. In detail, the gray scales of 2 and 6 are added as used gray scales from among the eleven gray scales 0, 1, 3, 7, 15, 31, 63, 105, 149, 201, and 255 allowable in the tenth contour noise stage. Also, when the contour noise stage is the eighth stage, the gray scale of non-uniform coding with the weight of 2 is added. Referring to FIG. 13, the gray scales of 4 and 5 can be added. The gray scales usable for the respective contour noise stages are predefined through the above-described method. In this instance, it is understood by a person skilled in the art that the gray scales available for the respective contour noise stages can be varied when the subfield arrangement does not correspond to the arrangement of FIG. 13 but has a different coding arrangement.

Dithering gray scale converter 430 uses the usable gray scales for the respective predefined contour noise stages, and determines whether the gray scale of the current pixel corresponds to an available gray scale according to the calculated contour noise stage of a block to which the current pixel belongs. Dithering gray scale converter 430 applies a dithering method (to be described below) and converts the gray scale of the current pixel when the gray scale of the current pixel does not belong to an available gray scale following the contour noise stage of the corresponding block, and dithering gray scale converter 430 outputs the gray scale of the current pixel when the gray scale of the current pixel belongs to the available gray scale.

As to applying the dithering method, dithering gray scale converter 430 determines an output candidate in step S220 by selecting two values from among the available gray scales in the contour noise stage of the block to which the current pixel belongs. That is, the nearest value from among values which are greater than the current gray scale and the nearest value from among values which are less than the current gray scale are determined from among the gray scales available in the contour noise stage. For example, when the current block has the tenth stage which is the highest and the current gray scale is 40, the gray scales of 31 and 63 which are the nearest to the gray scale of 40 are selected as output candidates from among the available gray scales of 0, 1, 3, 7, 15, 31, 63, 105, 149, 201, and 255. The gray scale finally output to the plasma display panel instead of the current given gray scale will be either of the two candidate gray scales. Dithering is used to select one of the two gray scales.

The dithering method is used to select an appropriate candidate from among the determined output candidates and represent it to be near the desired gray scale in an average manner within a predetermined area. When the current gray scale is 40 and the output candidates are 31 and 63, and three 31s and one 63 in the 2×2 area are determined to be outputs in the above-described example, the mean value in the 2×2 area becomes 39 and it is hence possible to represent the current gray scale of 40. In this instance, the output value from among the output candidates is determined according to per-pixel threshold values. That is, the value of 63 is output when the threshold value calculated per pixel is less than the value of 40, and the value of 31 is output when the same is greater than the value of 40.

Figures 14, 15:
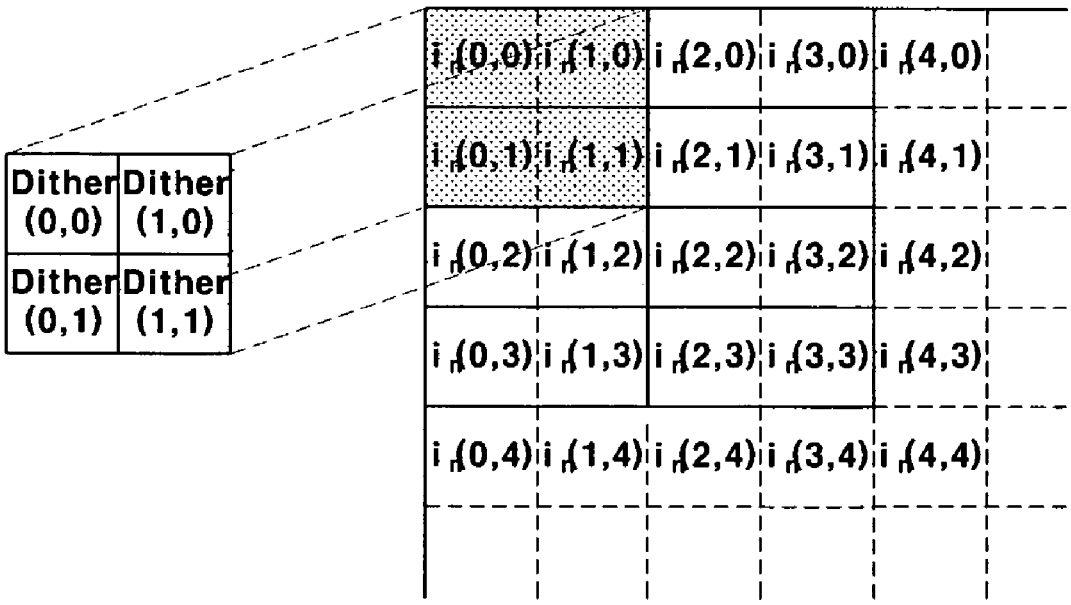
FIG. 14 shows an exemplified 8×8 dithering mask.
FIG. 15 shows a 2×2 dithering mask applied example.

The per-pixel threshold value is determined depending on two output candidates and the dimension of an area to be considered. For example, an interval between the two output candidates is divided with the same gaps in the four positions of the 2×2 area and the gaps are filled with threshold values in the case of considering the 2×2 area. That is, when the threshold values in the 2×2 area for the output candidates of 31 and 63 are determined, their gap becomes 6.4 (=(63−31)/5) and the threshold values are determined to be 37.4, 43.8, 50.2, 56.6, and accordingly, three 31s and one 63 are output for the input gray scale of 40. The process for determining the threshold values is given to be Equation 4.

$$\text{Threshold}(x, y) = level_{\min} + \frac{level_{\max} - level_{\min}}{\text{Dither_Size} + 1} \times \text{Dither}[y \ \%\ \text{D_h}][x \ \%\ \text{D_w}] \qquad \text{Equation 4}$$

where $level_{min}$ and $level_{max}$ respectively represent a small value and a large value from among the found output candidates, and Dither_Size has a value of 4 when the dimension of the area to be considered is a 2×2 area. Dither[ ][ ] is a dithering mask which is a component for determining arrangement positions of the determined threshold values. That is, the dithering mask determines the positions of the 2×2 area on which the four threshold values determined with respect to the 2×2 area are provided. The above-noted dithering mask is determined in various ways. FIG. 14 shows an exemplified 8×8 dithering mask. It is understood by a person skilled in the art in this instance that the dithering mask can be modified. D_w and D_h in Equation 4 are dimensions of a width and a height of the dithering mask, and % is an operator for calculating a remainder and is used to apply a predetermined dimension of the dithering mask to the whole image corresponding to one frame without superposition as shown in FIG. 15 which shows an exemplified case of a 2×2 dithering mask. Therefore, the threshold values of the respective pixels are calculated in the total frame image according to Equation 4.

When the threshold values of the respective pixels are calculated ins step S240, dithering gray scale converter 430 performs binarization in step S250. In the binarization process given in Equation 5, dithering gray scale converter 430 compares the gray scale of the current pixel with a large or small state of the corresponding threshold value, selects one of the two output candidates of $level_{min}$ and $level_{max}$, and represents the current gray scale in an average manner.

EQUATION 5

```
IF( i_n(x,y)<Threshold(x,y) )
{
    result(x,y) = level_min;
}
ELSE
{
    result(x,y) = level_max;
}
```

where $i_n(x,y)$ is a current gray scale at a random pixel, Threshold(x,y) is a threshold value at a random pixel, and result(x,y) is a gray scale output by the dithering gray scale converter 430.

Dithering gray scale converter 430 uses two or more dithering masks with different values, uses a method for alternately applying the dithering masks for each frame or within each frame, and thus eliminates unique and regular patterns of the dithering method.

Dithering gray scale converter 430 modifies the gray scale or outputs it without modification according to the contour noise stage estimated by contour noise estimator 410 and the current input gray scale.

In this instance, subfield converter 440 generates subfield data corresponding to the gray scale finally output by the dithering gray scale converter 430. That is, subfield converter 440 determines on/off states of the respective subfields (which represent the subfields with different brightness weights) and generates the subfield data in correspondence to the final output gray scale.

The subfield data output by subfield converter 440 are transmitted to PDP driver 500, that is, address driver 200 and scan and sustain driver 300 and are then displayed on plasma display panel 100 as indicated by step S300.

As described, contour noise is more accurately reduced by determining contour noise generation states for the respective stages, establishing gray scales applicable to the respective stages, using the dithering method, and converting the gray scales of the input image signals into gray scales (which are applicable for the respective stages) for reducing the contour noise.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A plasma display panel driver comprising:

a contour noise estimator responsive to an image signal of a current input frame and an image signal of a previous input frame, for calculating a coding error and a mean gray scale difference and determining a contour noise stage of the image signal of the current input frame for each block based on the coding error and the mean gray scale difference for each block;

a gray scale converter responsive to a contour noise estimate for determining whether the image signal of the current input frame is applicable to the contour noise stage determined by the contour noise estimator, determining whether to apply dithering, and using the dithering to convert an input gray scale into a gray scale for reducing the contour noise when applying the dithering; and a subfield converter responsive to a gray scale converter output for generating subfield data corresponding to the gray scale converted by the gray scale converter, wherein the contour noise estimator in a coding error stage uses weights of subfields and results generated by comparing light-emitted patterns of subfields of the image signal of the current input frame and light-emitted patterns of subfields of the image signal of the previous input frame to calculate the coding error, and wherein the contour noise estimator in a gray scale difference stage calculates gray scale differences between the image signal of the current input frame and the image signal of the previous input frame to calculate the mean gray scale difference.

2. The plasma display panel driver of claim 1, wherein the contour noise estimator has in advance contour noise generation probability information according to the coding error stage and the gray scale difference stage.

3. The plasma display panel driver of claim 1, wherein the gray scale converter has in advance gray scales applicable to the contour noise stage.

4. The plasma display panel driver of claim 1, wherein the gray scale converter converts no gray scale when the gray scale of the input image signal is a gray scale applicable to the contour noise stage, and uses dithering to convert the gray scale of the input image signal to a gray scale for reducing the contour noise when the gray scale of the input image signal is not a gray scale applicable to the contour noise stage.

5. The plasma display panel driver of claim 1, wherein the gray scale converter uses a large output candidate and a small output candidate the gray scale of which are the nearest the gray scale of the input image signal from among gray scales available in the contour noise stage corresponding to the input image signal, applies dithering, and converts the gray scale of the input image signal into a gray scale for reducing the contour noise by using dithering.

6. The plasma display panel driver of claim 5, wherein the gray scale converter uses two candidate output gray scales and a dithering mask, and determines a threshold value and an arranged position of the threshold value.

7. The plasma display panel driver of claim 3, wherein the number of gray scales had by the gray scale converter and applicable to the contour noise stage is increased when the contour noise generation probability is lowered.

8. An image processing method for a plasma display panel for dividing an image of a field displayed on the plasma display panel into a plurality of subfields in correspondence to an input image signal, representing gray scales according to combinations of the subfields, and displaying an image corresponding to the image signal, the method comprising:

(a) determining a contour noise stage based on coding errors and a mean gray scale difference calculated by using an image signal of a current input frame and an image signal of a previous input frame;

(b) determining whether the current input image signal is applicable to the contour noise stage determined in (a), and determining whether to apply dithering; and (c) converting the gray scale of the current input image signal into a gray scale for reducing the contour noise by using dithering, when it is determined to apply dithering in (b), wherein the coding error is calculated by using weights of subfields and results generated by comparing light-emitted patterns of subfields of the image signal of the current input frame and light-emitted patterns of subfields of the image signal of the previous input frame, and wherein the mean gray scale difference is calculated by calculating gray scale differences between the image signal of the current input frame and the image signal of the previous input frame.

9. The image processing method of claim 8, wherein (c) comprises:

determining a large candidate output gray scale and a small candidate output gray scale which are nearest the gray scale of the input image signal from among gray scales available to the contour noise stage corresponding to the input image signal;

using the candidate output gray scales and a dithering mask, and determining a threshold value; and using the threshold value, and determining one of the candidate output gray scales.

10. The image processing method of claim 8, wherein the number of gray scales applicable to the contour noise stage is increased when the contour noise generation probability is lowered in (b).

11. A plasma display panel comprising a plasma panel including first electrodes and second electrodes arranged in parallel on a first substrate and third electrodes formed to cross the respective first electrodes and the second electrodes on a second substrate;

a driver for applying sustain pulses for driving the first and second electrodes; and a controller for dividing a frame into a plurality of subfields and applying a control signal to the driver, the control signal controlling the number of the subfields which form the frame and the number of sustain pulses assigned to each subfield, wherein the controller comprises:

a contour noise estimator responsive to an image signal of a current input frame and an image signal of a previous input frame, for calculating a coding error and a mean gray scale difference, and determining a contour noise stage of the image signal of the current input frame for each block based on the coding error and the mean gray scale difference for each block;

a gray scale converter responsive to a contour noise estimate for determining whether the image signal of the current input frame is applicable to the contour noise stage determined by the contour noise estimator, determining whether to apply dithering, and using the dithering to convert an input gray scale into a gray scale for reducing the contour noise when applying the dithering; and a subfield converter responsive to a gray scale converter output for generating subfield data corresponding to the gray scale converted by the gray scale converter, wherein the contour noise estimator uses results generated by comparing light-emitted patterns of subfields of the image signal of the current input frame for each block and light-emitted patterns of subfields of the image signal of the previous input frame for each block and uses weights of the subfields to calculate the coding error for each block, and wherein the contour noise estimator calculates gray scale differences between the image signal of the current input frame for each block and the image signal of the previous input frame for each block to calculate the mean gray scale difference for each block.

12. An image processing method for a plasma display panel for dividing an image of a field displayed on the plasma display panel into a plurality of subfields in correspondence to an input image signal, representing gray scales according to combinations of the subfields, and displaying an image corresponding to the image signal, the method comprising:

(a) determining a contour noise stage based on a coding error and a mean gray scale difference calculated by using a first image signal of a current input frame and a second image signal of a previous input frame;

(b) determining whether a first image signal is applicable to the contour noise stage determined in (a);

(c) selecting a first gray scale and a second gray scale as output candidates from among gray scales available in the contour noise stage corresponding to the first image signal when the first image signal is determined not to be an applicable gray scale in (b); and (d) using the first gray scale and the second gray scale selected in (c), applying dithering, and representing the first image signal, wherein the coding error is calculated by using weights of subfields and results generated by comparing light-emitted patterns of subfields of the first image signal and light-emitted patterns of subfields of the second image signal, and wherein the mean gray scale difference is calculated by calculating gray scale differences between the first image signal and the second image signal.

13. The image processing method of claim 12, wherein:

the first gray scale is greater than and is nearest the first image signal from among gray scales available in the contour noise stage corresponding to the first image signal; and the second gray scale is less than and is nearest the first image signal from among gray scales available in the contour noise stage corresponding to the first image signal.

* * * * *